US009068804B2

(12) United States Patent
McPherson

(10) Patent No.: US 9,068,804 B2
(45) Date of Patent: Jun. 30, 2015

(54) BEVELED END PIECES FOR AN ARROW

(71) Applicant: MCP IP, LLC, Sparta, WI (US)

(72) Inventor: Mathew A. McPherson, Norwalk, WI (US)

(73) Assignee: MCP IP, LLC, Sparta, WI (US)

( * ) Notice: Subject to any disclaimer, the term of this patent is extended or adjusted under 35 U.S.C. 154(b) by 0 days.

(21) Appl. No.: 14/069,941

(22) Filed: Nov. 1, 2013

(65) Prior Publication Data

US 2014/0128183 A1 May 8, 2014

Related U.S. Application Data

(60) Provisional application No. 61/721,583, filed on Nov. 2, 2012.

(51) Int. Cl.
*F42B 6/06* (2006.01)
*F42B 6/04* (2006.01)

(52) U.S. Cl.
CPC .... *F42B 6/06* (2013.01); *F42B 6/04* (2013.01)

(58) Field of Classification Search
CPC ..... F42B 6/04; F42B 6/06
USPC ..... 473/578, 582, 585, 586
See application file for complete search history.

(56) References Cited

U.S. PATENT DOCUMENTS

| | | | | |
|---|---|---|---|---|
| 3,995,860 | A | 12/1976 | Manspeaker | |
| 4,210,330 | A | 7/1980 | Kosbab | |
| 4,398,354 | A | 8/1983 | Finlay | |
| 4,410,184 | A | 10/1983 | Anderson | |
| 4,656,994 | A | 4/1987 | Jenks | |
| 4,706,965 | A | 11/1987 | Schaar | |
| 4,866,810 | A | 9/1989 | Kudlacek | |
| 5,067,731 | A | 11/1991 | Bickel | |
| 5,290,044 | A * | 3/1994 | Easton et al. | 473/578 |
| 5,361,747 | A | 11/1994 | Laabs | |
| 5,417,439 | A | 5/1995 | Bickel | |
| 5,516,117 | A | 5/1996 | Rangel | |
| 5,919,105 | A | 7/1999 | Summers | |
| 5,921,875 | A * | 7/1999 | Bickel | 473/582 |
| 6,142,895 | A | 11/2000 | Jason | |
| 6,203,457 | B1 | 3/2001 | Snook | |
| 6,390,642 | B1 | 5/2002 | Simonton | |
| 6,428,433 | B1 | 8/2002 | Liechty, II | |
| 7,485,056 | B2 | 2/2009 | Sullivan et al. | |
| 8,057,330 | B2 | 11/2011 | Blosser et al. | |
| 8,251,845 | B2 | 8/2012 | Bay | |
| 8,257,208 | B2 | 9/2012 | Harding | |
| 8,267,815 | B2 | 9/2012 | Braun et al. | |
| 8,337,342 | B1 | 12/2012 | Huang | |
| 8,342,990 | B1 | 1/2013 | Price | |
| 8,403,777 | B1 | 3/2013 | Huang | |

* cited by examiner

*Primary Examiner* — John Ricci

(74) *Attorney, Agent, or Firm* — Vidas, Arrett & Steinkraus, P.A.

(57) ABSTRACT

Example nocks, arrowheads and/or arrowhead inserts include a tapered annular flange axially engaging a correspondingly tapered edge on a tubular arrow shaft. The tapered flange and edge help prevent the end of tubular arrow shaft from deforming radially outward when substantial axial force is applied to the nock, arrowhead and/or arrowhead insert.

19 Claims, 4 Drawing Sheets

BEVELED END PIECES FOR AN ARROW

CROSS-REFERENCE TO RELATED APPLICATIONS

This application claims the benefit of U.S. Provisional Patent Application Ser. No. 61/721,583 filed on Nov. 2, 2012, the entire contents of which are incorporated by reference herein.

FIELD OF THE INVENTION

The disclosed invention generally pertains to arrows and more specifically to nocks, arrowheads and other end pieces attachable to a hollow or solid arrow shaft.

BACKGROUND OF THE INVENTION

Arrows, bolts and/or projectiles for bows and crossbows typically include at least one insert disposed and engaged within the interior of at least one of the opposite ends of an arrow, bolt, or projectile shaft. The inserts are adapted to receive a replaceable head or arrowhead and/or a nock. Generally, the opposite ends of the arrow, bolt or projectile shaft are flat and are perpendicular to longitudinal direction of the shaft. During release of an arrow, bolt or projectile, and the striking of a target, one or both of the opposite ends of the arrow, bolt or projectile shaft will be exposed to significant forces occurring as a result of the radial pressure acting upon the inserts, and/or arrowhead, and the nock relative to the end of the shaft, which in turn may cause fracture or cracking of one or both of the opposite ends of the arrow, bolt or projectile shaft, as the inserts and/or arrowhead, or nock are forced toward the center of the shaft.

The present invention counteracts the radial forces acting on the opposite ends of the arrow, bolt or projectile shaft, reducing frequency of cracking or fracture of the shaft, prolonging the useful life of the arrow, bolt or projectile.

All US patents and applications and all other published documents mentioned anywhere in this application are incorporated herein by reference in their entirety.

Without limiting the scope of the invention a brief summary of some of the claimed embodiments of the invention is set forth below. Additional details of the summarized embodiments of the invention and/or additional embodiments of the invention may be found in the Detailed Description of the Invention below.

A brief abstract of the technical disclosure in the specification is provided as well only for the purposes of complying with 37 C.F.R. 1.72. The abstract is not intended to be used for interpreting the scope of the claims.

BRIEF SUMMARY OF THE INVENTION

In at least one embodiment, the invention herein is in general directed to an arrow device which includes a tubular shaft having a first end and a second end, the first end having a first bevel, and the second end having a second bevel. A nock is engaged to the first end, the nock comprising a first shank disposed in the tubular shaft, the nock further comprising a sixth bevel which is constructed and arranged for positioning adjacent to the first bevel. An insert is engaged to the second end, the insert comprising a second shank disposed in the tubular shaft, the insert further comprising a fifth bevel which is constructed and arranged for positioning adjacent to the second bevel. The insert further includes a third bevel located opposite to the second shank. A head is engaged to the insert proximate to the third bevel, the head comprising a fourth bevel which is constructed and arranged for positioning adjacent to the third bevel.

In at least one embodiment, a nock insert for use with an arrow shaft comprises a shank arranged to be inserted into the arrow shaft, an annular flange and a notch arranged to receive a bowstring. The annular flange surrounds the shank and comprises a beveled surface arranged to abut an end of the arrow shaft.

These and other embodiments which characterize the invention are pointed out with particularity in the claims annexed hereto and forming a part hereof. However, for a better understanding of the invention, its advantages and objectives obtained by its use, reference can be made to the drawings which form a further part hereof and the accompanying descriptive matter, in which there are illustrated and described various embodiments of the invention.

DETAILED DESCRIPTION OF THE INVENTION

Figure 1:
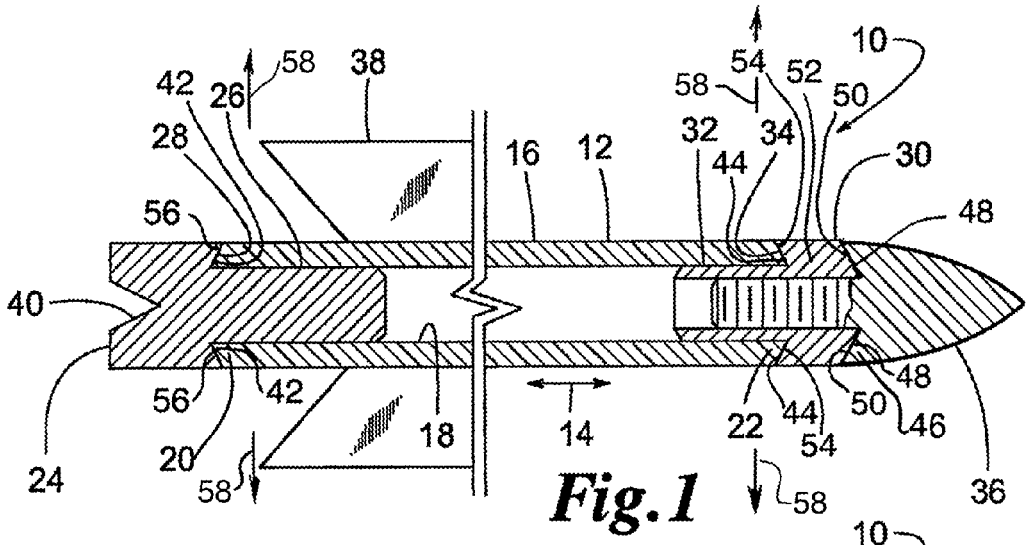
FIG. 1 is a partial cross-sectional side view of the opposite ends of one alternative embodiment of an arrow, bolt or projectile of the invention disclosed and described herein.

While this invention may be embodied in many different forms, there are described in detail herein specific embodiments of the invention. This description is an exemplification of the principles of the invention and is not intended to limit the invention to the particular embodiments illustrated.

For the purposes of this disclosure, like reference numerals in the figures shall refer to like features unless otherwise indicated.

In at least one alternative embodiment, FIG. 1 shows an arrow device 10 that comprises a tubular shaft 12 which is elongate in a longitudinal direction 14. Tubular shaft 12 has an outer surface 16, an inner surface 18, a first end 20 and a second end 22. The first end 20 includes a first bevel 42 and the second end 22 includes a second bevel 44 such that in at least one embodiment inner surface 18 is longer than outer surface 16 as measured in the longitudinal direction 14.

In at least one alternative embodiment, arrow device 10 includes a nock 24 with a string-receiving notch 40. Nock 24 comprises a first shank 26 and a first tapered annular flange 28. First shank 26 extends into the tubular shaft 12 to engage the inner surface 18. The first tapered annular flange 28 engages the first beveled end 20 of tubular shaft 12.

In some alternative embodiments, arrow device 10 includes an insert 30 comprising a second shank 32 and a second tapered annular flange 34. The second shank 32 extends into tubular shaft 12 to engage inner surface 18. The second tapered annular flange 34 engages the second beveled end 22 of the tubular shaft 12. In some alternative embodiments, a head or arrowhead 36 is screwed into or otherwise engaged to the insert 30.

In some alternative embodiments, arrow device 10 includes fletching 38.

In at least one embodiment nock 24 and/or insert 30 have a greater material density than the material used to form the tubular shaft 12.

In some alternative embodiments, the nock 24 and the insert 30 are examples of beveled end pieces for an arrow, bolt or projectile. In some alternative embodiments, head or arrowhead 36 has a third tapered annular flange 46 which is similar to the second tapered annular flange 34 and the first tapered annular flange 28. The head or arrowhead 36 has fourth bevel 48 which connects to the third bevel 50 of insert 30 for an arrow, bolt or projectile.

In at least one embodiment, continuing to refer to FIG. 1, the third bevel 50 and the matching fourth bevel 48 extend at an angle with respect to the head or arrowhead 36 of the arrow, bolt, or projectile. In some embodiments, the angle between the third bevel 50 and the exterior edge of the second shank 32 will be equal to or less than 85°, and in some embodiments equal to or less than 60°, or even 45°. In other embodiments, the angle between the exterior edge of the second shank 32 and the third bevel 50 will be equal to or greater than 5° and equal to or less than 85°. In some embodiments, the second shank 32, insert 30, and the forward member 52 of the insert 30, are cylindrical, or ring-shaped. In some embodiments, the third tapered annular flange 46 is circular in shape to position and engage the third bevel 50 to the fourth bevel 48. In some embodiments, the angle of the fourth bevel 48 relative to the second shank 32 is equal to 180° minus the angle between the third bevel 50 and the second shank 32, and will be equal to, or greater than 95° and equal to or less than 175°.

In at least one embodiment, the forward member 52 of the insert 30 includes a rearwardly disposed fifth bevel 54. In at least one embodiment, the angle between the exterior edge of the second shank 32 and the fifth bevel 54 is identical to the angle between the second shank 32 and the third bevel 50. In other embodiments, the angle between the fifth bevel 54 and the second shank 32 will not be identical to the angle between the third bevel 50 and the second shank 32.

At least one embodiment, the fifth bevel 54 extends at an angle relative to the head or arrowhead 36 of the arrow, bolt or projectile. In some embodiments the angle between the fifth bevel 54 and the second shank 32 will be more than 95° and less than 175°.

In at least one embodiment, the tubular shaft 12 includes the second bevel 44. In at least one embodiment, the angle between the exterior edge of the second shank 32 and the second bevel 44 is identical to the angle between the second shank 32 and the third bevel 50. In other embodiments, the angle between the second bevel 44 and the second shank 32 will not be identical to the angle between the third bevel 50 and the second shank 32. In at least one embodiment, the second bevel 44 extends at an angle relative to the head or arrowhead 36 of the arrow, bolt or projectile. In some embodiments, the angle between the second bevel 44 and the second shank 32 will be equal to or less than 85° and greater than or equal to 5°. In some embodiments, the angle between the fifth bevel 54 relative to the second shank 32 is equal to 180° minus the angle between the second bevel 44 and the second shank 32, and will be equal to or greater than 95° and less than or equal to 175°.

Continuing to refer to FIG. 1, in at least one embodiment nock 24 having first shank 26 is inserted within and/or releasably engaged to the interior of the first end 20 of the tubular shaft 12. The nock 24 includes the first tapered annual flange 28, and in some embodiments a sixth bevel 56. In at least one embodiment, the sixth bevel 56 is constructed and arranged to be positioned adjacent to, and to engage the first bevel 42.

In at least one embodiment, the sixth bevel 56 matches the first bevel 42 and extends angularly away from the nock 24 towards the head or arrowhead 36 of the arrow, bolt or projectile. In some embodiments, the angle between the first bevel 42 and the exterior edge of the first shank 26 will be equal to or less than 85°, and in some embodiments equal to or less than 60°, or even 45°.

In some embodiments the nock 24 and the first tapered annular flange 28 are cylindrical, circular, and/or ring-shaped to position, match, and to engage the sixth bevel 56 to the first bevel 42 of the shaft 12. In some embodiments, the angle of the sixth bevel 56 relative to the first shank 26 is equal to 180° minus the angle between the first bevel 42 and the first shank 26, and will be equal to or greater than 95° and equal to or less than 175°.

In at least one embodiment the angle selected for the first bevel 42 relative to the first shank 26 is equal to, or different as compared to, either of the angle selected for the second bevel 44 relative to the second shank 32, or the angle selected for the third bevel 50 relative to the second shank 32. In at least one embodiment, none of the angles of the first bevel 42 relative to the first shank 26, or the second bevel 44 relative to the second shank 32, or the third bevel 50 relative to the second shank 32 are equal or identical. In other embodiments, all of the bevel angles for the first bevel 42, the second bevel 44, and the third bevel 50 are equal. In alternative embodiments, two or more of the bevel angles for the first bevel 42, second bevel 44 and third bevel 50 are equal or unequal in dimension, in any combination.

Figure 9:
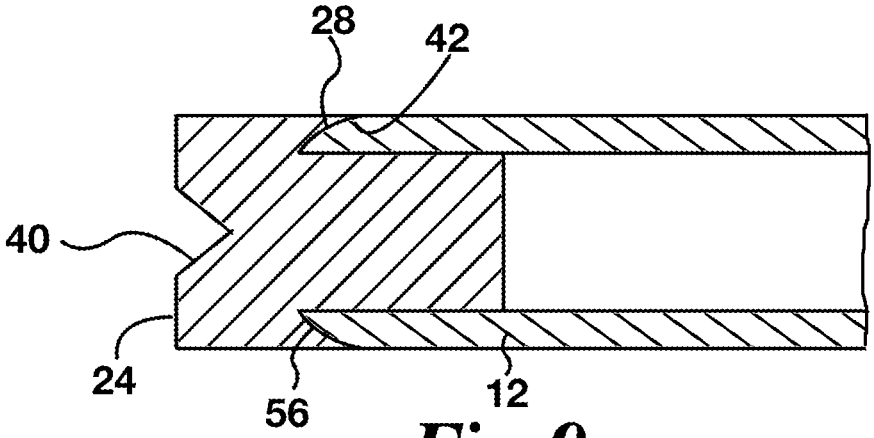
FIG. 9 shows another embodiment of a nock.
Figure 10:
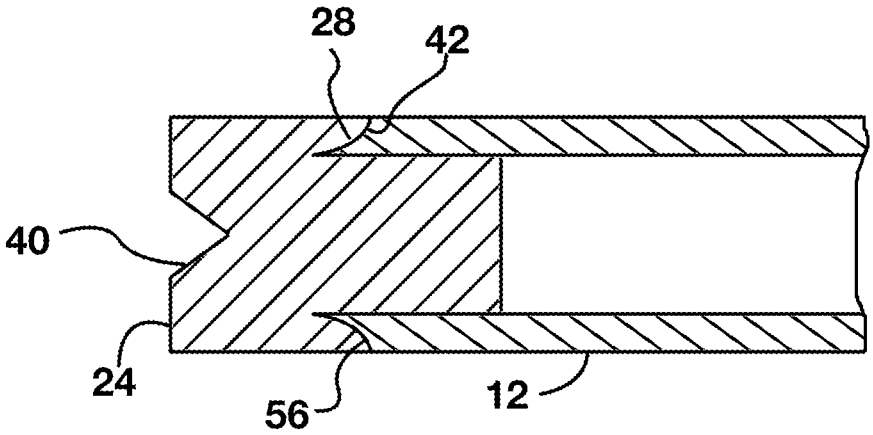
FIG. 10 shows another embodiment of a nock.

In some embodiments, the first bevel 42, second bevel 44, third bevel 50, fourth bevel 48, fifth bevel 54, and/or sixth bevel 56 are linear in shape. In alternative embodiments, any one or more of the matching pairs of bevel's, such as the first bevel 42 and sixth bevel 56, the second bevel 44 and the fifth bevel 54, and the third bevel 50 and the fourth bevel 48 may not be linear, and may be curved, arctuate, parabolic, etc., provided that the bevel edges of each matching pair of bevels are configured for nesting engagement relative to each other. For example, FIGS. 9 and 10 show embodiments of a nock 24 comprising a bevel 56 having curvature. The bevel 56 can comprise any suitable shape and orientation. In some embodiments, the curvature is concave with respect to the tubular shaft 12, as shown in FIG. 9. In some embodiments, the curvature is convex with respect to the tubular shaft 12, as shown in FIG. 10. Desirably, the bevel 56 is arranged such that at least a portion of the nock 24 surrounds a portion of the tubular shaft 12, allowing the nock 24 to provide reinforcement in a radially inward direction.

In some embodiments, only one pair of three matching pairs of bevel edges are not linear, and in alternative embodiments, two or all three of the matching pairs of bevel edges are not linear. In further embodiments, any combination of matching pairs of bevel edges may include linear or nonlinear edges, which may be incorporated into the arrow device 10, as described herein without limitation or restriction. For example, the pair of bevel edges 42 and 56 may be linear, and a pair of bevel edges 44 and 54 may not be linear, while the pair of bevel edges 50 and 48 may be either linear or nonlinear. Any combination of matching pairs of bevel edges may be provided herein.

In at least one embodiment, as an arrow device 10 is released from a drawn position, or as head or arrowhead 36 strikes an object, radial forces are exposed/projected onto first tapered annular flange 28 and second tapered annular flange 34 in the direction of arrow 58. Radial forces 58 at the first tapered annular flange 28 and the second tapered annular flange 34 desirably reduce potential for damage to the tubular shaft 12.

In some embodiments, the inclusion of any combination of the first bevel 42, second bevel 44, third bevel 50, fourth bevel 48, fifth bevel 54, and/or sixth bevel 56, assist to redistribute, or to dissipate forces acting on the first tapered annular flange 28 and/or the second tapered annular flange 34, to reduce potential for damage to the tubular shaft 12 proximate to the first and 20 or the second and 22.

In at least one embodiment, the inclusion of the matching pairs of beveled edges 42 and 56; 44 and 54; and 50 and 48 function to counteract and to reduce the radial outward forces exposed to the first end 20 and the second end 22 of shaft 12 in the direction of arrow 58. Desirably, portions of an outer member positioned to surround an inner member will reinforce the inner member. For example, portions of a nock 24 that are positioned to surround the tubular shaft 12 (e.g. bevel 56 and annular flange 28) will reinforce the tubular shaft 12 against expanding in diameter.

The matching pair of bevel edges 42 and 56 provide engagement between the nock 24 and the first tapered annular flange 26 to reduce any potential for cracking and/or fracture of the first end 20 of the tubular shaft 12. The matching pair of bevel edges 44 and 54 provide an engagement between the insert 30 and the second tapered annular flange 24 to reduce a potential for cracking and/or fracture of the second end 22 of the tubular shaft 12.

The matching pair of bevel edges 50 and 48 provide an engagement between the insert 30 and the third tapered annular flange 46 to reduce a potential for cracking and/or fracture of the second end 22 of the tubular shaft 12 or the insert 30. The engagement between the matching pairs of bevel edges enhances the structure of the arrow device 10 to minimize the effects of the radial outward forces 58, in turn reducing a potential for cracking or fracture of the first end 20 and second end 22 of the tubular shaft 12.

Figure 2:
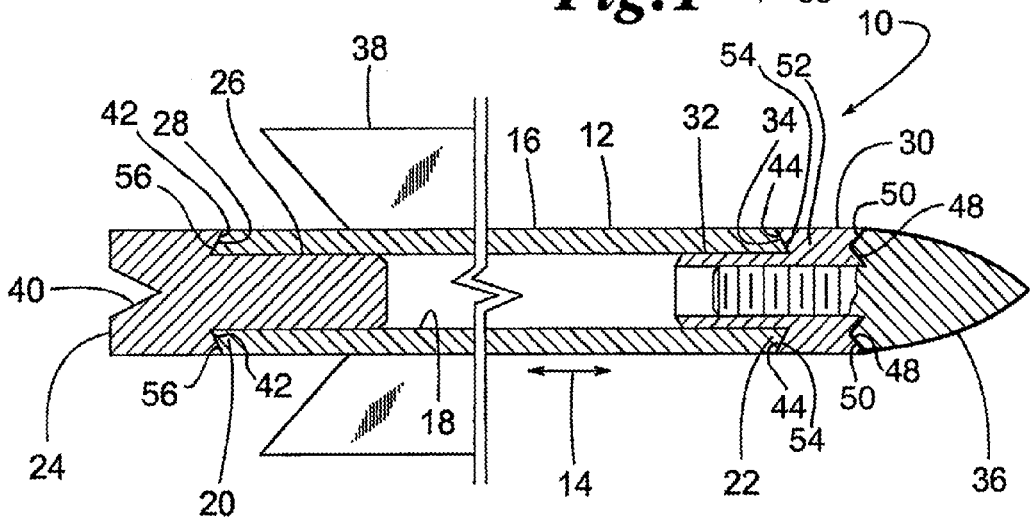
FIG. 2 is a partial cross-sectional side view of the opposite ends of one alternative embodiment of an arrow, bolt or projectile of the invention disclosed and described herein.

In at least one embodiment as depicted in FIG. 2, the fourth bevel 48 includes a double edge forming a point which is positioned at the approximate center of the forward member 52 of the insert 30. In this embodiment, the third bevel 50 is shaped to include a channel to receive the double edge/point of the fourth bevel 48. In some embodiments, the point of the double edge of the fourth bevel 48 may be offset from the center of the tubular wall of the forward member 52 of the insert 30 internally towards the center of the tubular shaft 12, or outwardly toward the outer surface 16 of the tubular shaft 12. In this embodiment, the attributes, functions and features of the first bevel 42, sixth bevel 56, second bevel 44, and the fifth bevel 54 are substantially identical to the embodiments previously described with respect to FIG. 1.

Figure 3:
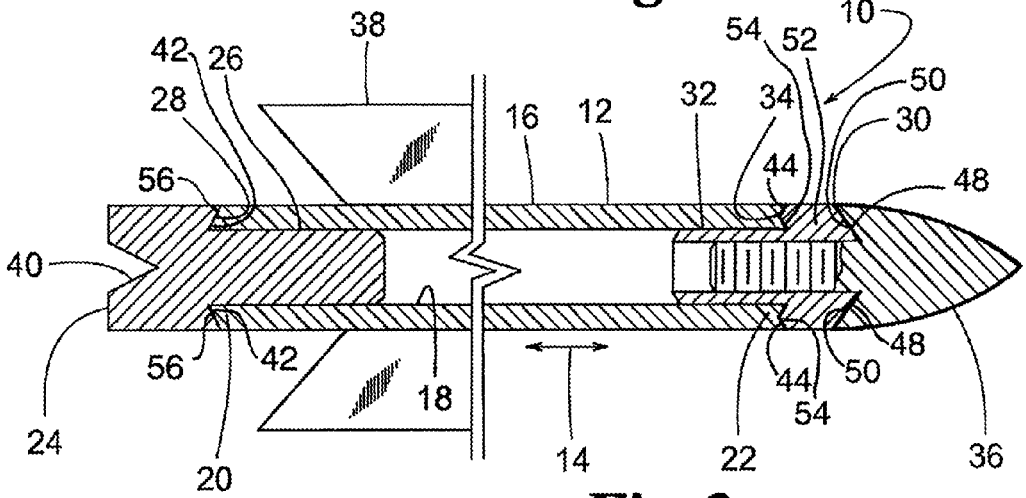
FIG. 3 is a partial cross-sectional side view of the opposite ends of one alternative embodiment of an arrow, bolt or projectile of the invention disclosed and described herein.

In at least one embodiment as depicted in FIG. 3, the fifth bevel 54 includes a double edge forming a point which is positioned at the approximate center of the wall of the tubular shaft 12. In this embodiment, the second bevel 44 is shaped to include a channel to match and receive the double edge/point of the fifth bevel 54. In some embodiments, the point of the double edge of the fifth bevel 54 may be offset from the center of the wall of the tubular shaft 12 internally towards the center, or may be offset outwardly toward the outer surface 16 of the tubular shaft 12. In this embodiment, the attributes, functions and features of the first bevel 42, sixth bevel 56, third bevel 50, and the fourth bevel 48 are substantially identical to the embodiment previously described with respect to FIG. 1.

When a bevel includes a double edge forming a point, in some embodiments, the beveled surface forms a V-shape. When two of such V-shaped surfaces abut one another (e.g. 48, 50 in FIG. 2), the V-shapes can provide for a self-alignment between the two surfaces. For example, the point of the V-shape of one surface nests within the valley of the V-shape of the other surface. Additionally, in some embodiments, multiple V-shaped portions are positioned at a plurality of locations about an interface (e.g. 48, 50 in FIG. 2) between two abutting objects (e.g. 30, 36 in FIG. 2), for example being a plurality of individual, spaced V-shaped portions or continuous V-shaped surfaces that extend continuously about the objects. Such V-shaped portions and/or surfaces can provide for coaxial alignment of the central axes of the objects.

Figure 4:
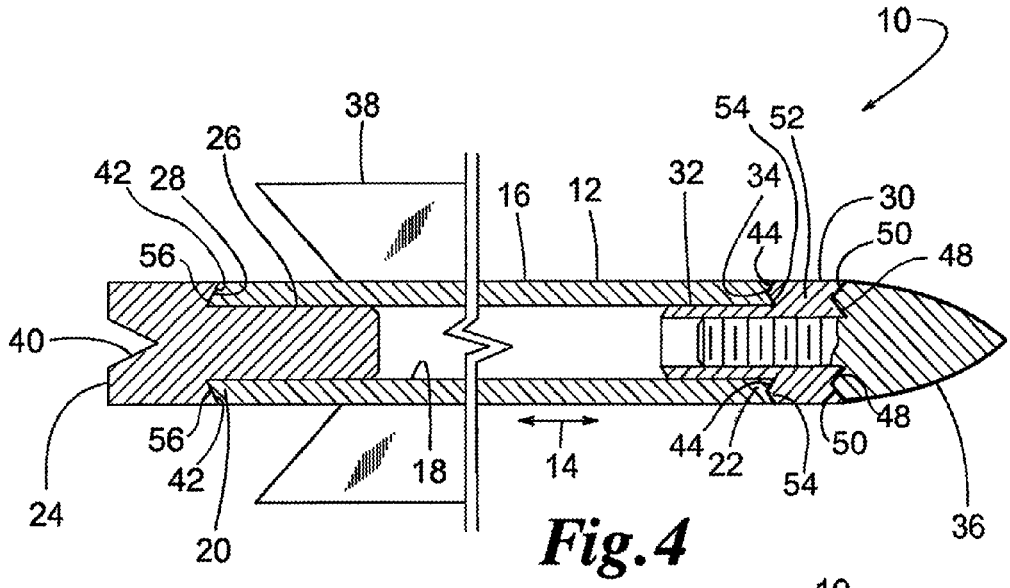
FIG. 4 is a partial cross-sectional side view of the opposite ends of one alternative embodiment of an arrow, bolt or projectile of the invention disclosed and described herein.

In at least one embodiment as depicted in FIG. 4, the fourth bevel 48 includes a double edge forming a point which is positioned at the approximate center of the forward member 52 of the insert 30 as described with respect to FIG. 2. The other features, attributes, and functions as related to the fourth bevel 48 as described relative to FIG. 2 are equally applicable to FIG. 4 herein. In addition, in some embodiments as depicted in FIG. 4, the fifth bevel 54 includes a double edge forming a point which is positioned at the approximate center of the tubular shaft 12 as described with respect to FIG. 3. The other features, attributes, and functions as related to the fifth bevel 54 as described relative to FIG. 3 are equally applicable to FIG. 4 herein. In some embodiments, the features, attributes, and functions as related to FIGS. 2 and 3 herein have been incorporated into the embodiment as depicted in FIG. 4. In the embodiment as depicted in FIG. 4 the features, attributes, and functions of the first bevel 42 and the sixth bevel 56 are substantially identical to the embodiment as previously described with respect to FIG. 1.

Figure 5:
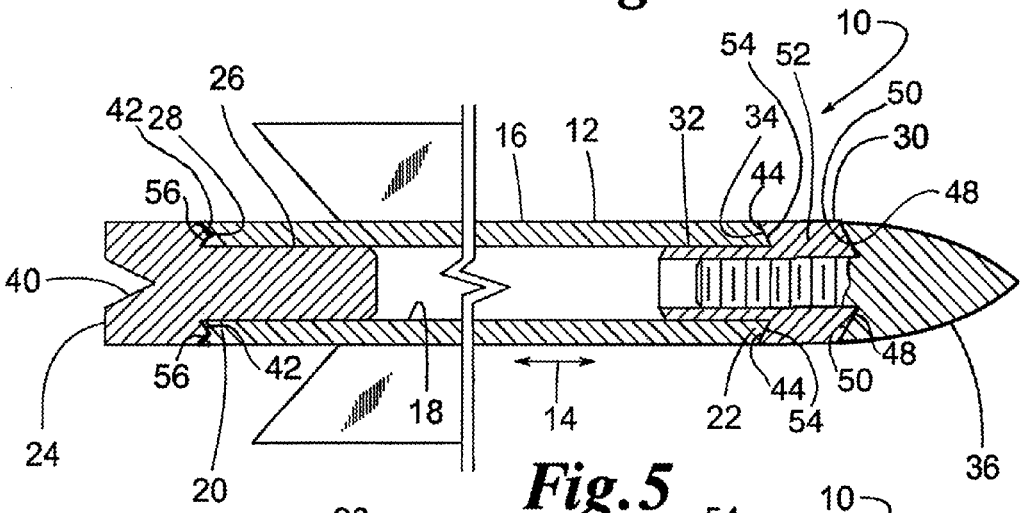
FIG. 5 is a partial cross-sectional side view of the opposite ends of one alternative embodiment of an arrow, bolt or projectile of the invention disclosed and described herein.

In at least one embodiment as depicted in FIG. 5, the sixth bevel 56 includes a double edge forming a point which is positioned at the approximate center of the wall of the first end 20 of the tubular shaft 12. In this embodiment, the first bevel 42 is shaped to include a channel to match and receive the double edge/point of the sixth bevel 56. In some embodiments the point of the double edge of the sixth bevel 56 may be offset from the center of the wall of the tubular shaft 12 towards the center, or alternatively may be offset outwardly towards the outer surface 16. In this embodiment, the second bevel 44, fifth bevel 54, third bevel 50 and fourth bevel 48 have the attributes, features, and functions, and are substantially identical to the embodiment previously described with respect to FIG. 1.

Figure 6:
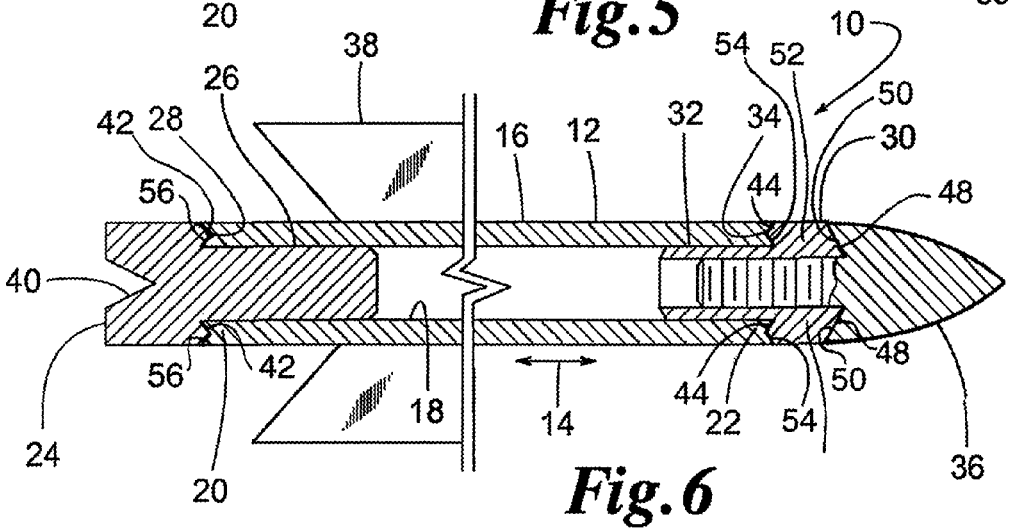
FIG. 6 is a partial cross-sectional side view of the opposite ends of one alternative embodiment of an arrow, bolt or projectile of the invention disclosed and described herein.

In at least one alternative embodiment as depicted in FIG. 6, the third bevel 50 and the fourth bevel 48 have the features, attributes, and functions as previously described relative to FIG. 1. In at least one embodiment the fifth bevel 54 includes a double edge forming a point, and the second bevel 44 includes a channel as previously described as related to FIGS.

3 and 4, having the features, attributes, and functions as previously described. In at least one embodiment the sixth bevel 56 includes a double edge forming a point and the first bevel 42 includes a channel as previously described with respect to FIG. 5, which includes the features, attributes and functions as previously described herein.

Figure 7:
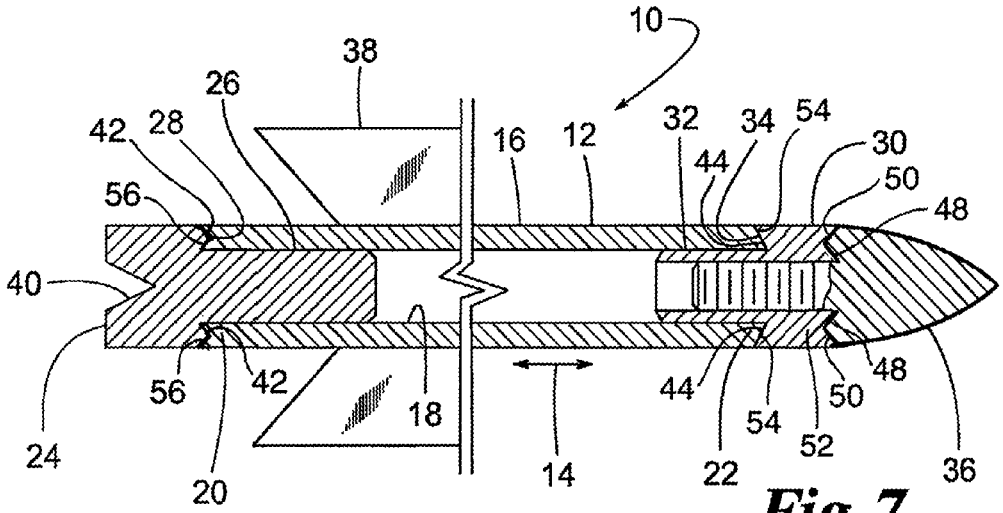
FIG. 7 is a partial cross-sectional side view of the opposite ends of one alternative embodiment of an arrow, bolt or projectile of the invention disclosed and described herein.

In at least one embodiment as depicted in FIG. 7, the fourth bevel 48 includes a double edge forming a point, and the third bevel 50 includes a channel having the features, attributes and functions as previously described related to FIGS. 2 and 4. In addition, in at least one embodiment, the fifth bevel 54 and the second bevel 44 include the features, attributes and functions as previously described relative to FIG. 1. In some embodiments, the sixth bevel 56 includes a double edge forming a point and the first bevel 42 includes a channel as previously described as related to FIGS. 5 and 6, which includes the features, attributes, and functions as previously described.

Figure 8:
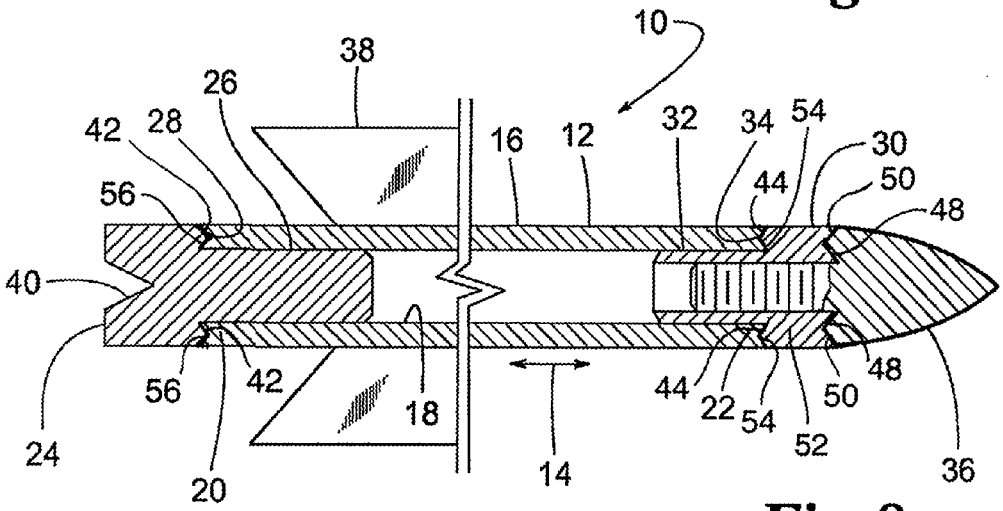
FIG. 8 is a partial cross-sectional side view of the opposite ends of one alternative embodiment of an arrow, bolt or projectile of the invention disclosed and described herein.

In at least one embodiment as depicted in FIG. 8, the fourth bevel 48 includes a double edge forming a point, and the third bevel 50 includes a channel having the features, attributes and functions as previously described related to FIGS. 2, 4, and 7. In addition, at least one embodiment, the fifth bevel 54 includes a double edge forming a point, and the second bevel 44 includes a channel having the features, attributes, and functions as previously described related to FIGS. 3, 4, and 6. In at least one embodiment, the sixth bevel 56 includes a double edge forming a point and the first bevel 42 includes a channel as previously described as related to FIGS. 5, 6, and 7 which include the features, attributes, and functions as previously described.

Figure 11:
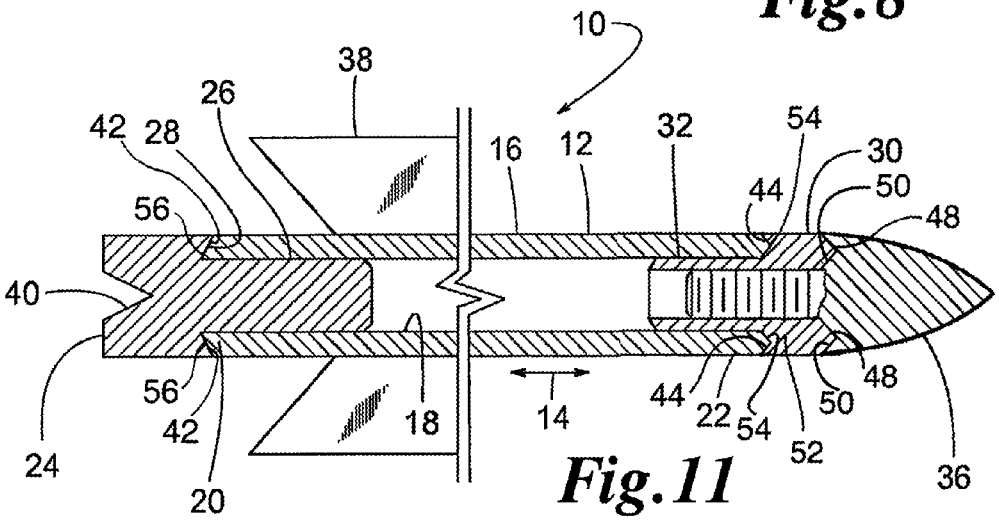
FIG. 11 is a partial cross-sectional side view of the opposite ends of one alternative embodiment of an arrow, bolt or projectile of the invention disclosed and described herein.

FIG. 11 shows another embodiment of an arrow, bolt or projectile. When a bevel (e.g. 42, 44, 48, 50, 54, 56) includes a double edge forming a point, the point can be oriented in any suitable direction. In some embodiments, a bevel (e.g. 48) comprises a V-shape oriented in a first direction, such as a first axial or forward direction with respect to the arrow, as illustrated in FIG. 11. In some embodiments, a bevel (e.g. 48) comprises a V-shape oriented in a second direction that is opposite the first direction. For example, the second direction can be a second axial or backwards direction with respect to the arrow, as illustrated in FIG. 8.

In some embodiments, one or both of the insert 30 and/or the nock 24 may be formed of one or more materials which are selected to provide force absorption, force redirection, force dissipation, or cushion, having a coefficient of elasticity and/or compression which is utilized to reduce potential for cracking and/or fracture of the first end 20 and/or second end 22 of the tubular shaft. In some embodiments the density and/or coefficient of elasticity of the material selected for the insert 30 and/or the nock 24 may vary between the respective first shank 26 or second shank 32, and the end of either of the insert 30 or nock 24.

In at least one embodiment, the inclusion of additional material, or denser material, in the area of the first tapered annular flange 28, second tapered annular flange 34, and third tapered annular flange 46 reduces the potential for cracking or fracture of the first end 20 or the second end 22 of the tubular shaft.

In some alternative embodiments, the inclusion of the first bevel 42 and the sixth bevel 56; the second bevel 44 and the fifth bevel 54; and the third bevel 50 and the fourth bevel 48, reduce potential for cracking and/or fracture of the first end 20 and/or the second end 22 of the tubular shaft 12.

In at least one embodiment, the angle between the first bevel 42 and the first shank 26; the second bevel 44 and the second shank 32; and the third bevel 50 and the second shank 32 is approximately 75°. In alternative embodiments the angle for the first bevel 42, second bevel 44 and the third bevel 50 may be increased or decreased to minimize risk of cracking or fracture of the first end 20 or second end 22 of the arrow shaft 12.

In at least one alternative embodiment, any one or more of the fourth bevel 48; fifth bevel 54 and sixth bevel 56 may include a single, double, or more than two edges similar to a matching tooth and groove design. In some embodiments, the sides of the edges of a double bevel for the fourth bevel 48; fifth bevel 54 and six bevel 56 may have the same length dimension or angle. In alternative embodiments, the sides of the edges of a double bevel for the fourth bevel 48; fifth bevel 54 and six bevel 56 may either have the same length dimension or angle or different length dimensions or angles in any combination.

In some alternative embodiments the receiving channel(s) of the third bevel 50, second bevel 44 and/or first bevel 42 each include a corresponding or mating number of channels, angles, dimensions, and/or shapes to receive the respective fourth bevel 48, fifth bevel 54 and six bevel 56 for the arrow device 10 as provided in any combination of elements.

In a first alternative embodiment, an arrow device comprises a tubular shaft having a first end and a second end, the first end having a first bevel, said second end having a second bevel; a nock engaged to the first end, the nock comprising a first shank disposed in the tubular shaft, the nock further comprising a sixth bevel constructed and arranged for positioning adjacent to the first bevel; an insert engaged to the second end, the insert comprising a second shank disposed in the tubular shaft, the insert further comprising a fifth bevel constructed and arranged for positioning adjacent to the second bevel and a third bevel opposite to the second shank; and a head engaged to the insert, the head comprising a fourth bevel constructed and arranged for positioning adjacent to the third bevel.

In a second alternative embodiment according to the first alternative embodiment, the first bevel is at an acute angle relative to the tubular shaft.

In a third alternative embodiment according to the first alternative embodiment, the second bevel is at an acute angle relative to the tubular shaft.

In a fourth alternative embodiment according to the first alternative embodiment, the third bevel is at an acute angle relative to the tubular shaft.

In a fifth alternative embodiment according to the first alternative embodiment, the first bevel and the second bevel are at an acute angle relative to the tubular shaft.

In a sixth alternative embodiment according to the first alternative embodiment, the first bevel and the third bevel are at an acute angle relative to the tubular shaft.

In a seventh alternative embodiment according to the first alternative embodiment, the second bevel and the third bevel are at an acute angle relative to the tubular shaft.

In an eighth alternative embodiment according to the first alternative embodiment, the first bevel, the second bevel and the third bevel are at an acute angle relative to the tubular shaft.

In a ninth alternative embodiment according to the first alternative embodiment, the first bevel comprises a channel and the sixth bevel comprises a point.

In a tenth alternative embodiment according to the first alternative embodiment, the second bevel comprises a channel and the fifth bevel comprises a point.

In an eleventh alternative embodiment according to the first alternative embodiment, the third bevel comprises a channel and the fourth bevel comprises a point.

In a twelfth alternative embodiment according to the first alternative embodiment, the first bevel comprises a channel and the sixth bevel comprises a point and the second bevel comprises a channel and the fifth bevel comprises a point.

In a thirteenth alternative embodiment according to the first alternative embodiment, the first bevel comprises a channel and the sixth bevel comprises a point and the third bevel comprises a channel and the fourth bevel comprises a point.

In a fourteenth alternative embodiment according to the first alternative embodiment, the second bevel comprises a channel and the fifth bevel comprises a point and the third bevel comprises a channel and the fourth bevel comprises a point.

In a fifteenth alternative embodiment according to the first alternative embodiment, the first bevel comprises a channel and the sixth bevel comprises a point, the second bevel comprises a channel and the fifth bevel comprises a point, and the third bevel comprises a channel and the fourth bevel comprises a point.

In a sixteenth alternative embodiment according to the first alternative embodiment, the nock further comprises a first tapered annular flange wherein the sixth bevel is a surface of the first tapered annular flange.

In a seventeenth alternative embodiment according to the first alternative embodiment, the insert further comprises a second tapered annular flange wherein the fifth bevel is a surface of the second tapered annular flange.

In an eighteenth alternative embodiment according to the first alternative embodiment, the head further comprises a third tapered annular flange wherein the fourth bevel is a surface of the third tapered annular flange.

In a nineteenth alternative embodiment according to the first alternative embodiment, each of the first bevel, the second bevel, and the third bevel have an outer surface, and at least one of the outer surface for the first bevel, the second bevel, and the third bevel is substantially linear.

In a twentieth alternative embodiment according to the first alternative embodiment, each of the first bevel, the second bevel, and the third bevel have an outer surface, and at least one of the outer surfaces for the first bevel, the second bevel, and the third bevel are arcuate.

The above examples and disclosure are intended to be illustrative and not exhaustive. These examples and description will suggest many variations and alternatives to one of ordinary skill in this art. Further, the particular features presented in the dependent claims can be combined with each other in other manners within the scope of the invention such that the invention should be recognized as also specifically directed to other embodiments having any other possible combination of the features of the dependent claims.

This completes the description of the alternate embodiments of the invention. Those skilled in the art may recognize other equivalents to the specific embodiment described herein which equivalents are intended to be encompassed by the claims attached hereto.

The invention claimed is:

1. An Arrow Device Comprising:

a tubular shaft having a first end and a second end, said first end having a first bevel, said second end having a second bevel;

a nock engaged to said first end, said nock comprising a first shank disposed in said tubular shaft, said nock further comprising a sixth bevel constructed and arranged for positioning adjacent to said first bevel;

an insert engaged to said second end, said insert comprising a second shank disposed in said tubular shaft, said insert further comprising a fifth bevel constructed and arranged for positioning adjacent to said second bevel and a third bevel opposite to said second shank; and a head engaged to said insert, said head comprising a fourth bevel constructed and arranged for positioning adjacent to said third bevel.

2. The arrow device according to claim 1, wherein said first bevel is at an acute angle relative to said tubular shaft.

3. The arrow device according to claim 1, wherein said second bevel is at an acute angle relative to said tubular shaft.

4. The arrow device according to claim 1, wherein said third bevel is at an acute angle relative to said tubular shaft.

5. The arrow device according to claim 1, wherein said first bevel and said second bevel are at an acute angle relative to said tubular shaft.

6. The arrow device according to claim 1, wherein said first bevel and said third bevel are at an acute angle relative to said tubular shaft.

7. The arrow device according to claim 1, wherein said second bevel and said third bevel are at an acute angle relative to said tubular shaft.

8. The arrow device according to claim 1, wherein said first bevel, said second bevel and said third bevel are at an acute angle relative to said tubular shaft.

9. The arrow device according to claim 1, said first bevel comprising a channel and said sixth bevel comprising a point.

10. The arrow device according to claim 1, said second bevel comprising a channel and said fifth bevel comprising a point.

11. The arrow device according to claim 1, said third bevel comprising a channel and said fourth bevel comprising a point.

12. The arrow device according to claim 1, said first bevel comprising a channel and said sixth bevel comprising a point and said second bevel comprising a channel and said fifth bevel comprising a point.

13. The arrow device according to claim 1, said first bevel comprising a channel and said sixth bevel comprising a point and said third bevel comprising a channel and said fourth bevel comprising a point.

14. The arrow device according to claim 1, said second bevel comprising a channel and said fifth bevel comprising a point and said third bevel comprising a channel and said fourth bevel comprising a point.

15. The arrow device according to claim 1, said first bevel comprising a channel and said sixth bevel comprising a point, said second bevel comprising a channel and said fifth bevel comprising a point, and said third bevel comprising a channel and said fourth bevel comprising a point.

16. The arrow device according to claim 1, said nock further comprising a first tapered annular flange wherein said sixth bevel is a surface of said first tapered annular flange.

17. The arrow device according to claim 1, said insert further comprising a second tapered annular flange wherein said fifth bevel is a surface of said second tapered annular flange.

18. The arrow device according to claim 1, wherein each of said first bevel, said second bevel, and said third bevel have an outer surface, and at least one of said outer surface for said first bevel, said second bevel, and said third bevel is arcuate.

19. A nock insert for use with an arrow shaft comprising:

a shank arranged to be inserted into said arrow shaft;

an annular flange comprising a beveled surface, said annular flange surrounding said shank, said beveled surface arranged to abut an end of said arrow shaft wherein said beveled surface comprises curvature; and a notch arranged to receive a bowstring.

* * * * *